United States Patent [19]

Näpflin

[11] 3,951,424

[45] Apr. 20, 1976

[54] SAFETY SKI BINDING

[76] Inventor: Hans Näpflin, Kastanienallee 5, CH-6375 Beckenried, Switzerland

[22] Filed: July 2, 1975

[21] Appl. No.: 592,663

[30] Foreign Application Priority Data

July 2, 1974 Switzerland ..... 9083/74

[52] U.S. Cl. ..... 280/618; 280/633; 280/614

[51] Int. Cl.[2] ..... A63C 9/08

[58] Field of Search ..... 280/11.35 K, 11.35 Y, 280/11.35 E, 11.35 O, 11.35 A, 11.35 C, 11.35 T, 11.35 B, 11.35 R

[56] References Cited

UNITED STATES PATENTS

| | | | |
|---|---|---|---|
| 2,513,926 | 7/1950 | Erwin | 280/11.35 T |
| 3,003,777 | 10/1961 | Hilding | 280/11.35 B |
| 3,284,092 | 11/1966 | Rumaner | 280/11.35 K |
| 3,489,424 | 1/1970 | Gertsch et al. | 280/11.35 K |
| 3,685,849 | 8/1972 | Marker et al. | 280/11.35 T |
| 3,771,806 | 11/1973 | Hinterholzer et al. | 280/11.35 K |
| 3,845,964 | 11/1974 | Johnson | 280/11.35 T |

FOREIGN PATENTS OR APPLICATIONS

| | | | |
|---|---|---|---|
| 2,016,988 | 10/1971 | Germany | 280/11.35 R |
| 2,063,163 | 6/1972 | Germany | 280/11.35 K |

*Primary Examiner*—Robert R. Song
*Assistant Examiner*—Milton L. Smith
*Attorney, Agent, or Firm*—Karl F. Ross; Herbert Dubno

[57] ABSTRACT

A safety ski binding comprises a plate adapted to be secured to the sole of a skiboot and held on a ski by means of a heel clamp and a toe clamp. The toe clamp is provided with a wheel pivoted about an upright axis perpendicular to the longitudinal axis of the ski and having a circumferential groove lying generally in a plane parallel to the surface. The front end of the plate is formed with an edge extending perpendicular to the plate and adapted to be received within the groove of the wheel. The heel clamp has at its front end a pair of laterally spaced rollers and behind and between them a compressable pin. The rear end of the plate is formed with a pair of forwardly open seats which are pressed against the rollers by the pin. Pivoting of the plate compresses the pin using one of the rollers as a fulcrum.

6 Claims, 12 Drawing Figures

SAFETY SKI BINDING

CROSS REFERENCE TO RELATED APPLICATION

This application is related to copending and commonly filed patent application Ser. No. 592,662 filed July 2, 1975.

FIELD OF THE INVENTION

The present invention relates to a ski binding. More particularly this invention concerns a safety plate-type ski binding.

BACKGROUND OF THE INVENTION

In a plate-type safety ski binding each of the skiboots is fitted with a plate that in turn is secured at its front or toe end and heel or rear end on the upper surface of the ski. A spring-loaded pressing pin which can swivel in several directions pushes this plate against an abutment. If a plate is twisted or tipped with a force exceeding a predetermined level the pressure pin will swivel and release the plate from the ski.

Some such bindings have complicated devices both at toe and heel of the ski. These are separately adjusted for various kinds of release action. Such bindings are relatively expensive and frequently very hard to adjust. Furthermore it is often a relatively tricky procedure to fit the skiboot carrying the plate into the binding.

In a particular type of plate binding a circular pivot disk is used instead of the pressure pin. This disk engages in a longitudinal slot approximately in the center of the boot-mounted plate. Thus this plate is pivotal about the axis of the disk and simultaneously is displaceable to a limited extent longitudinally of the ski. The rear end of the plate has a beveled abutment surface which is circularly arcuate and centered on the axis of the disk and which lies on a corresponding surface of the ski-mounted binding. A spring-loaded locking pin engages the plate and presses it against the abutment surface. The plate and therefore the boot can be turned sideways. In case of a fall forward the plate can also spring out of the holder against the force of the spring.

In practice it has been found that the force needed to return a slightly twisted plate back to its centered position is considerably too great. In theory the force of the pivot pin should be taken up by the pivot disk until the two abutment surfaces fit tightly within one another. The spring force of the pivotal pin cannot be adjusted to achieve this effect except when the plate is slid forward in falling. The plate can however be pulled off the ski if it is pushed forward with considerable force, as for example when the skier passes over something that brakes his ski.

OBJECTS OF THE INVENTION

It is therefore an object of the present invention to provide an improved ski binding.

Another object is the provision of a plate-type safety ski binding.

Yet another object is to provide a ski binding which is inexpensive to manufacture and which releases the ski boot under certain circumstances while being easy to don.

SUMMARY OF THE INVENTION

These objects are attained according to the present invention in a safety ski binding having a plate securable to a ski boot and itself having a rear heel end formed with a pair of generally forwardly open seats spaced apart transversely to the longitudinal direction of the ski, and with a front end having an edge extending generally perpendicularly to the direction of the ski. A toe clamp is provided with a wheel pivoted about an upright axis perpendicular to the longitudinal direction of the ski and to the upper surface of the ski and having a circumferential groove lying generally in a plane parallel to the upper surface of the ski. A heel clamp is provided with a pair of rollers spaced apart transversely to the ski and with a swivelable pin having a forward end engageable against the plate between the seats and provided with spring means to urge the plate forwardly so that the edge is pressed into the groove and the seats are pressed forwardly against the rollers.

With the system according to the present invention, it is possible for the plate to be twisted relatively far out of its normal position parallel to the ski before the binding is effective so as to release this plate and free the ski boot from the ski. Thus a limited amount of freedom is possible for the plate relative to the ski while at the same time the plate will automatically be biased back into its starting position unless a predetermined lifting or twisting force is exerted on the plate. Unlike the prior art safety plate-type binding there is no friction when the plate is fitted into the binding. Lateral displacement of the plate displaces its front end slightly away from the wheel. Sliding of the plate forwardly does not in and of itself free the plate from the ski unless simultaneously the heel of the skiboot is raised with a force exceeding the predetermined maximum.

According to another feature of this invention the heel clamp is provided with an abutment on which the pin is secured. This pin has a front part engageable against the rear end of the plate and a rear part slidable relative to the front part. The spring means constitutes an annular elastomeric body between these two parts.

According to another feature of the present invention the rollers that normally engage in the seats and the plate are equispaced from a central axis of the ski and are tapered upwardly away from the ski.

According to the present invention the seats each fit exactly against a respective roller and each has an arc length of 90° so as to peripherally engage a quarter of this roller.

In accordance with yet another feature of the present invention the plate is formed forwardly of each of the seats with a cutout and the plate is of a width between the cutouts substantially less than its width between the seats. This allows the plate to be fitted into the ski by hooking one of the cutouts over one of the rollers and then pivoting the plate inwardly so as to compress the elastomeric body. Once the plate is in proper position parallel to the ski the pin will press the plate forward with each of the rollers fitting snugly into a respective seat.

BRIEF DESCRIPTION OF THE DRAWING

The above and other objects, features and advantages will become more readily apparent from the following, reference being made to the accompanying drawing in which.

SPECIFIC DESCRIPTION

Figure 1:
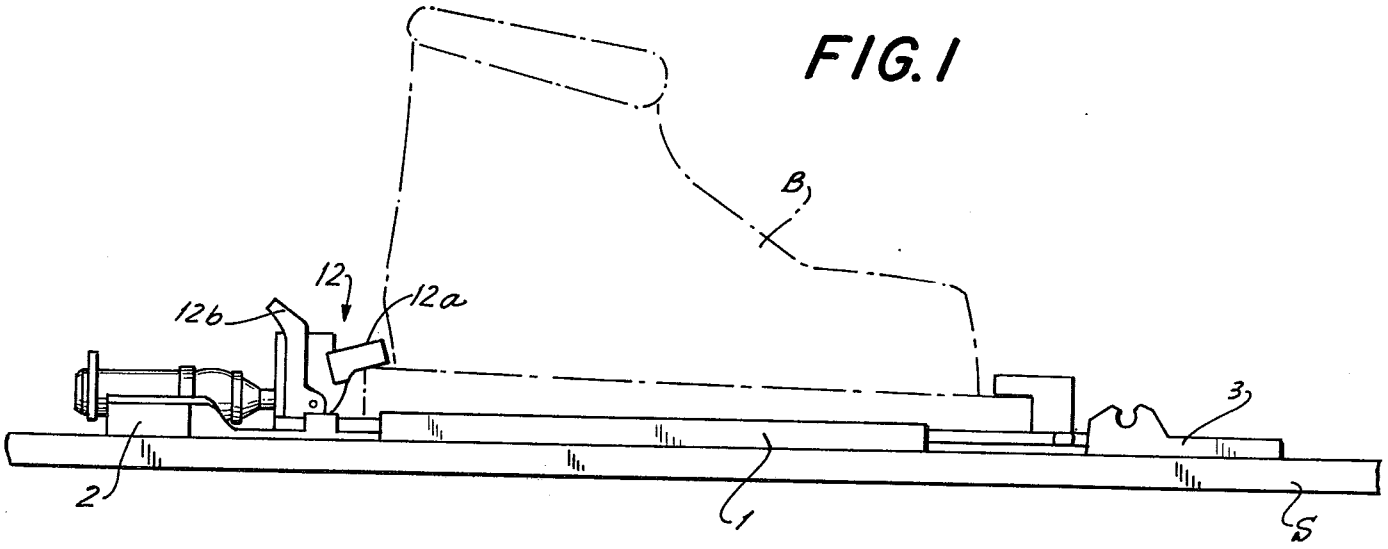
FIGS. 1 and 2 are side and top views, respectively, of the binding according to the present invention.
Figure 2:
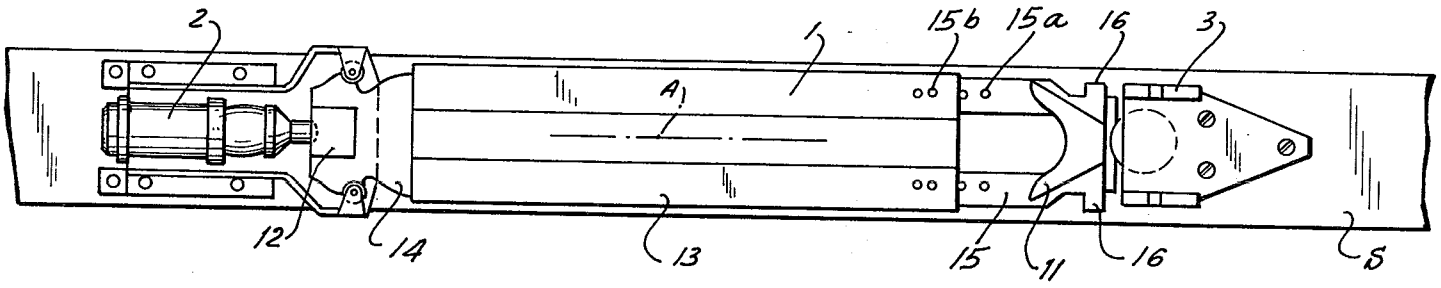

As shown in FIGS. 1 and 2 a ski S with a longitudinal axis A has a heel clamp 2 and a toe clamp 3 between which is secured a sole plate 1 clamped to the toe of a skiboot at 11 and to the heel of the skiboot by means of a holddown clip 12*a* carried on an upright 12 and actuated by an operating lever 12*b*.

As best seen in FIG. 2 the plate 1 is formed of a front U-shaped part 15 whose legs are each formed with a row of throughgoing holes 15*a*. A central hollow member 13 slidably receives the two legs of the U-shaped member 15 and rivets 15*b* between the members 13 and 15 can lock the two together in different longitudinal positions to adjust for different boot sizes. The back of the hollow central part 13 carries a thick steel plate 14. In addition the front portion of the front element 15 is provided with two lateral tabs 16 which allow the plate 1 to be pivotally connected to the front clamp 3 in order to use the binding for racing.

Figure 3:
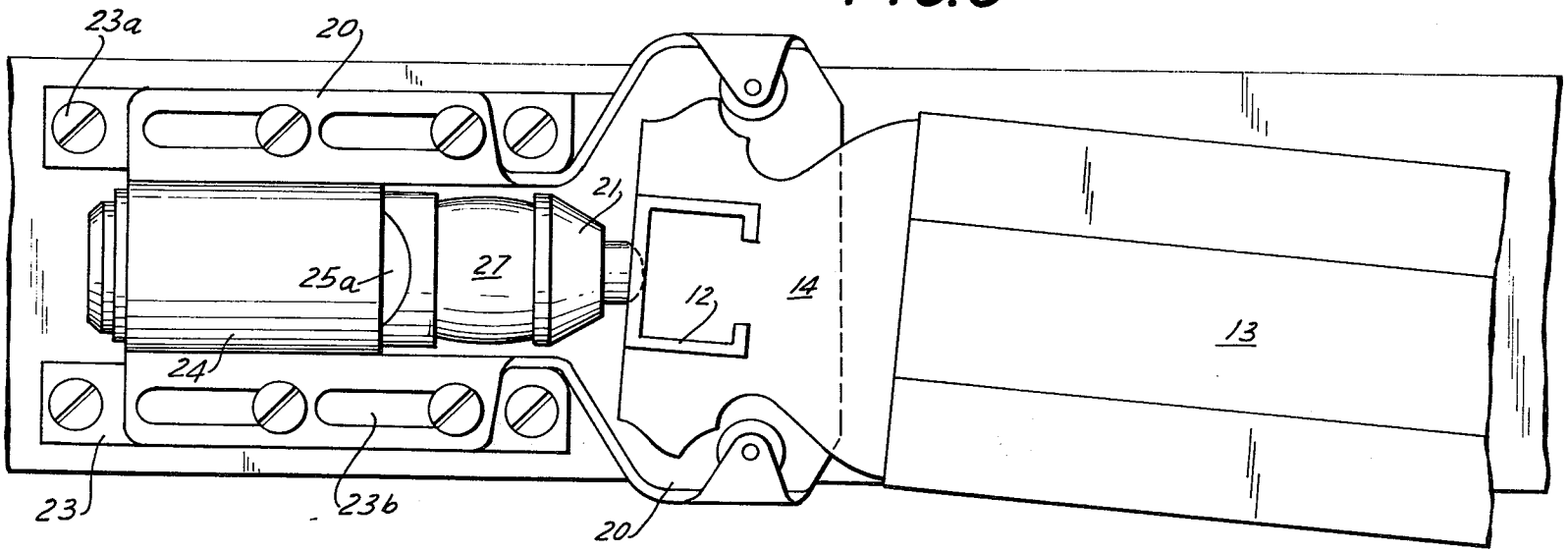
FIGS. 3 and 4 are large-scale top views of the heel clamp of the binding according to the present invention, in two different positions.
Figure 4:
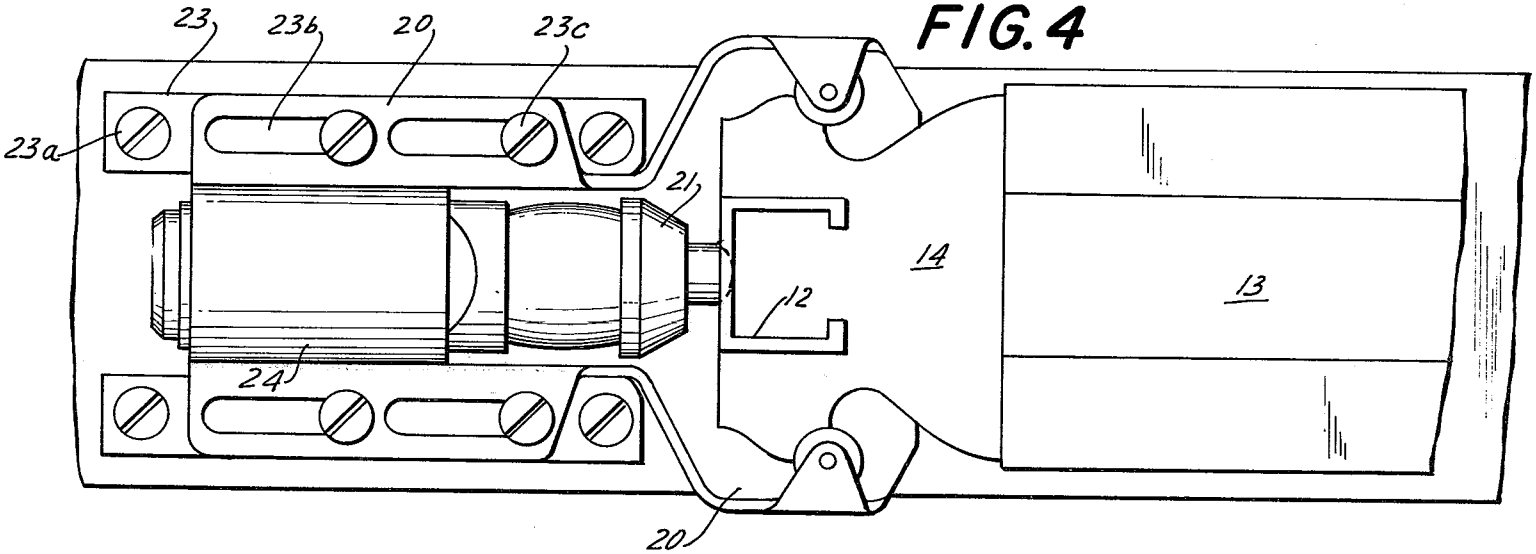
Figure 8:
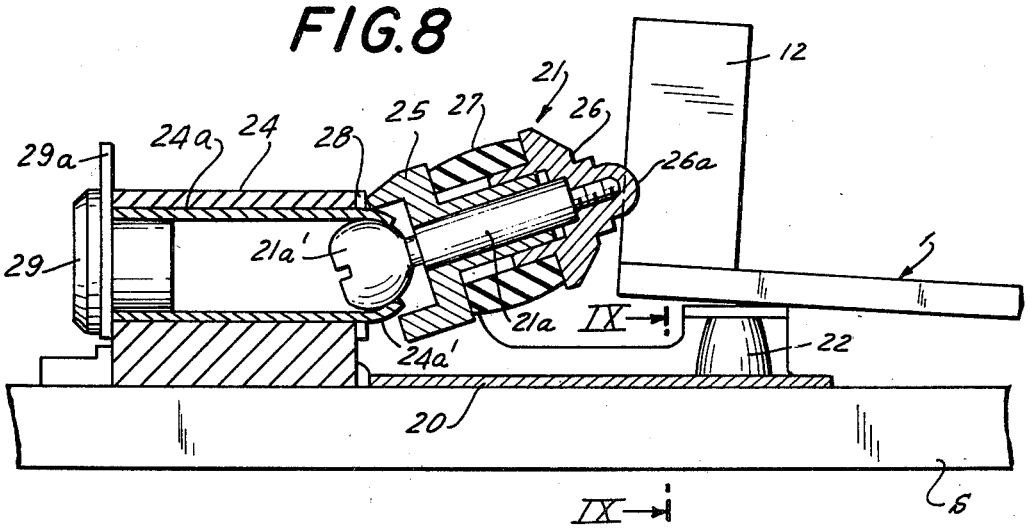
FIG. 8 is a longitudinal section through the heel clamp of the binding according to this invention.
Figure 12:
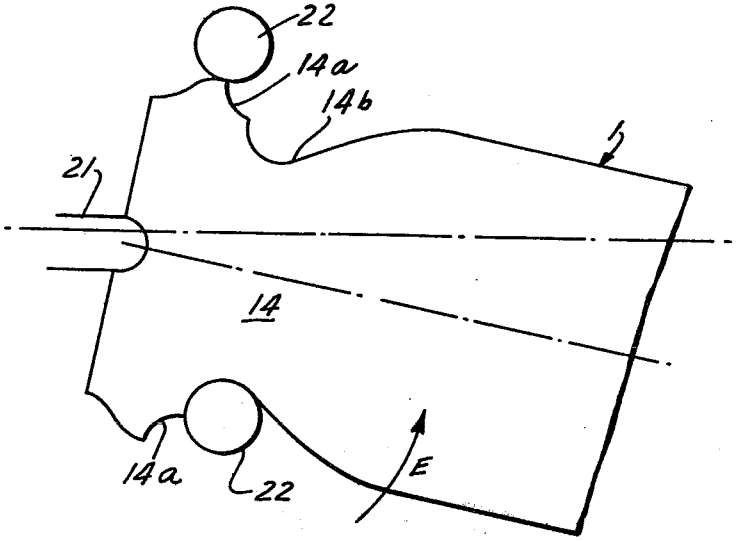
FIG. 12 is a view similar to FIG. 11 showing how the rear part of the sole plate is fitted into the rear clamp.

The rear clamp 2 as shown in FIGS. 3, 4 and 8 basically comprises an axially compressible pin 21 having a front end 26*a* engaging in a concavity 12*a* (see FIG. 9) on the upright 12. The rear end of this pin 21 bears against a support 24 secured to a plate 20 riding on two rails 23 secured by screws 23*a* to the ski S. Screws 23*c* engage between elongated slots 23*b* in the plate 20 and the plates 23 so as to allow the longitudinal position of the plate 20 relative to the rails 23 and the ski S to be adjusted for boot length. At its front the plate 20 is provided with two laterally spaced and upwardly tapered pins 22 spaced apart so that at their closest they are separated by a distance *x* (FIG. 12).

The support 24 is provided with a cylindrical sleeve 24*a* which is narrowed at its front end 24*a'* to form a seat and which is closed at its rear end by means of a metal plug 29 securing in place an eyelet 29*a* for attachment of the skier's safety ties. The pin 21 is formed of two telescoping sections 25 and 26, the latter being threaded onto the end of a screw 21*a* having a head 21*a'* swivelable in the seat 24*a'* formed at the front edge of the sleeve 24*a*. Between the bodies 25 and 26 is an elastomeric annular sleeve 27 that is axially compressable so as to allow the pin 21 to shorten axially. The support 24 is provided around the end of the sleeve 24*a* with a steel ring and the upper edge of the back part 25 is beveled at 25*a* so as to reduce the force on swiveling of the pin 21 upwardly. The force with which the front end 26*a* presses in the recess 12*a* is therefore determined by the elasticity of the elastomeric body 27.

The rear part 14 of the plate 1 is formed with a pair of quarter-cylindrical seats 14*a* and adjacent thereto with further seats 14*b*. The seats 14*a* are generally forwardly open and spaced apart by the distance *x* so that it is possible to fit the rear section 14 in the clamp 2 such that the two rollers 22 lie snugly in these seats 14*a*. This is illustrated in FIG. 12 where it is clear that the pin 21 can press the plate 1 forwardly with a pressure $K_F$ so as to bring about a reaction force $K_R$ from the rollers 22. The component $K_L$ of this reaction force parallel to the longitudinal direction of the ski combines with the force $K_F$ so as to keep the plate 1 centered in the position illustrated in FIG. 11.

These seats 14*a* are both tangent to a common plane P lying immediately behind them and perpendicular to the axis A so that twisting of the plate 1 in either direction relative as illustrated in FIG. 3 will compress the pin 21. Since however as the the compression increases on twisting so does the restoring force so that relatively constant resisting pressure is obtained. Therefore as will be described below freeing of the plate 1 is dependent on angular position and not on force.

When however the plate 1 has been twisted beyond a predetermined limit the one roller 22 will slip from the seat 14*a* into the deeper seat 14*b* and the other roller 22 will slip completely out of its seat and allow the plate to slip out from between the pin 21 on one side and the rollers 22 on the other.

Figure 9:
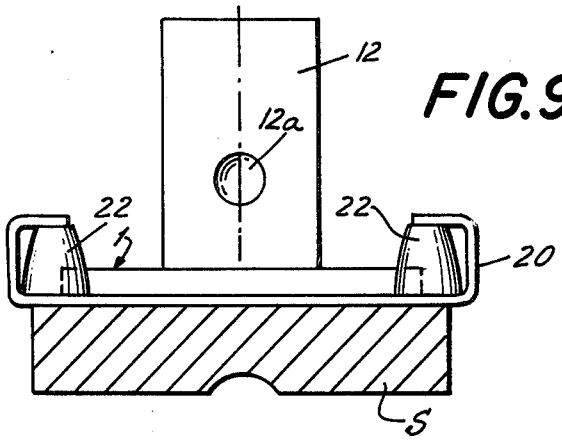
FIGS. 9 and 10 are sections taken along line IX of FIG. 8 with the sole plate shown in two different positions.
Figure 10:
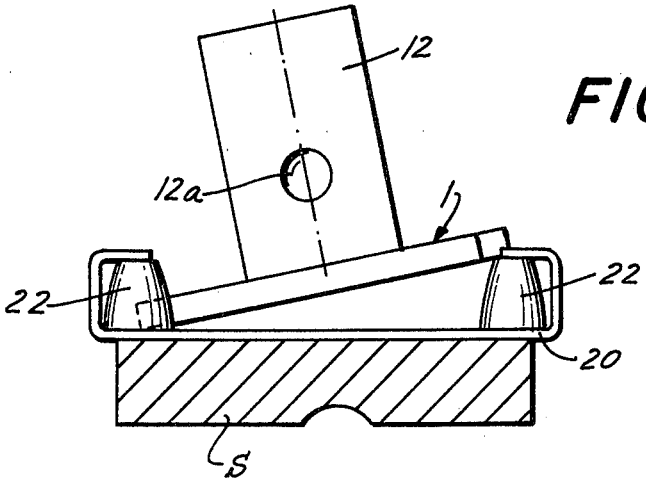
Figure 11:
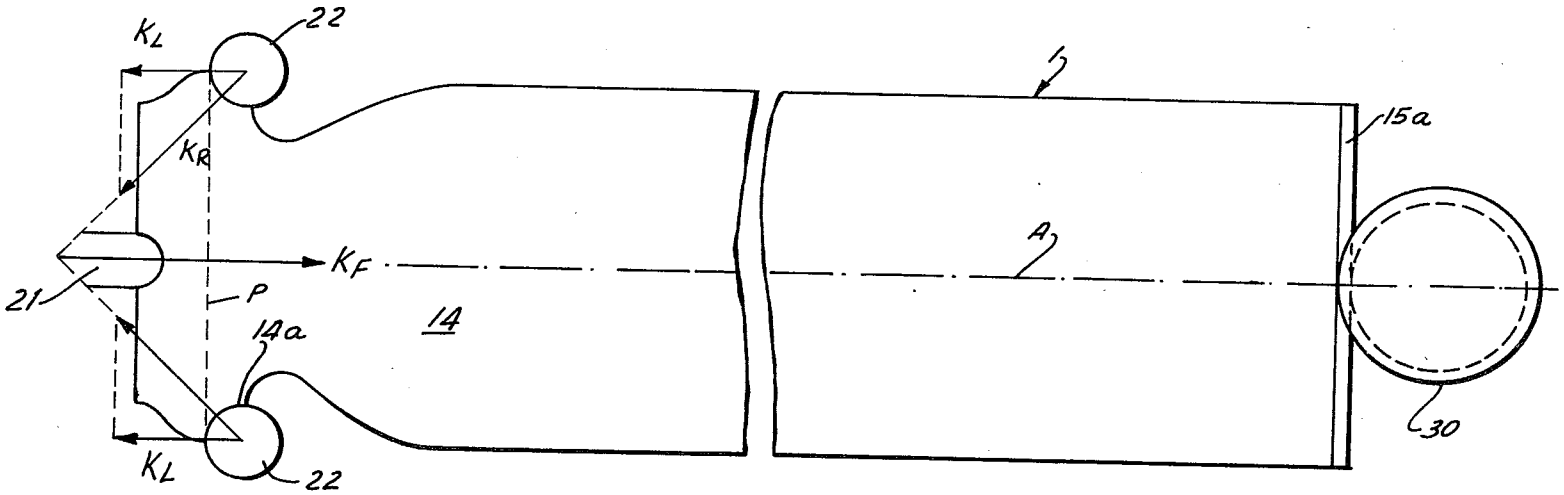
FIG. 11 is a top diagrammatic view illustrating the way in which the sole plate is held in the ski binding according to the present invention.

The opposite type of action allows the skier easily to don his skis; that is, he or she hooks the plate 1 with one of its deeper seats 14*b* around the respective roller 22 and simply twists the ski to the side, automatically compressing the pin 21. As soon as the plate 1 is generally parallel to the axis A of the ski it will snap in place as illustrated in FIG. 11. In any case if the plate 1 is forced forwardly along the axis A in line with the force $K_F$ the plate will in no way slip out of its binding. Should however, as shown in FIGS. 9 and 10, the heel of the skiboot be tipped in either direction the plate 1 will pull away from one or the other of the rollers 22 and allow the heel of the ski to come free of the binding.

Figure 5:
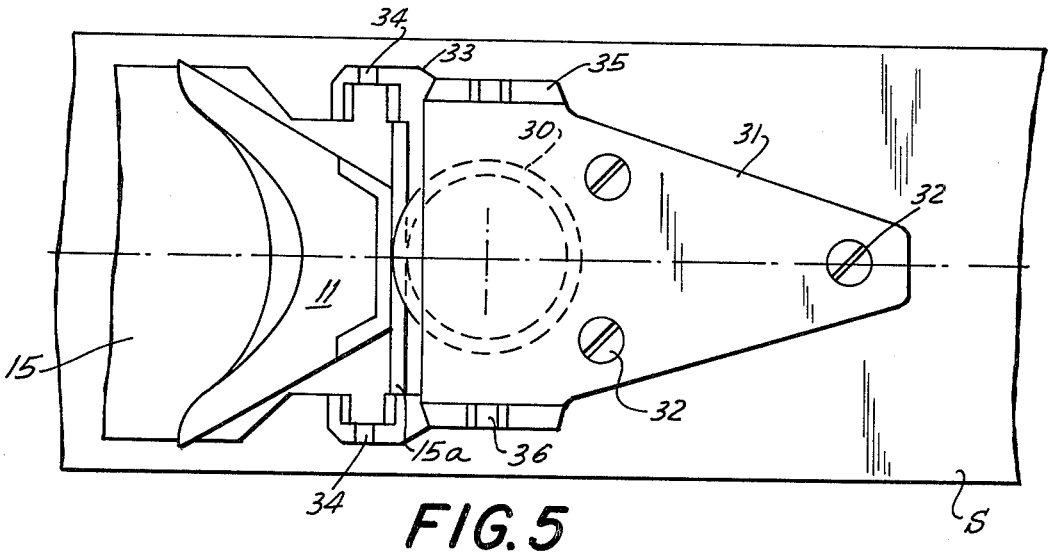
FIG. 5 is a top view of the toe clamp according to the present invention.
Figure 6:
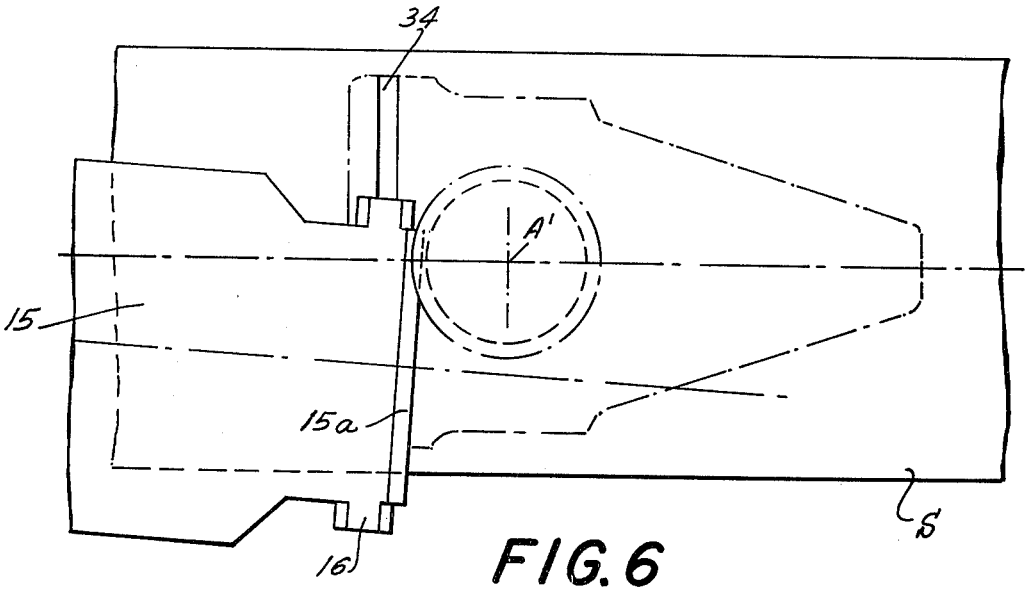
FIG. 6 is a view similar to FIG. 5 illustrating operation of the toe clamp.

The toe end of the plate is as shown in FIGS. 5, 6 and 11 formed with a V-shaped forwardly pointed edge 15*a* received in a peripheral groove 30*a* in a wheel 30 journaled about a vertical axis A' in a front mounting place 31 secured by means of screws to the top surface of the ski S. The front sharp edge 15*a* of the plate 1 extends at a right angle to the plate 1 so that pivoting of the front end of plate 1 relative to the ski will force the rear end back against the pin 21.

Figure 7:
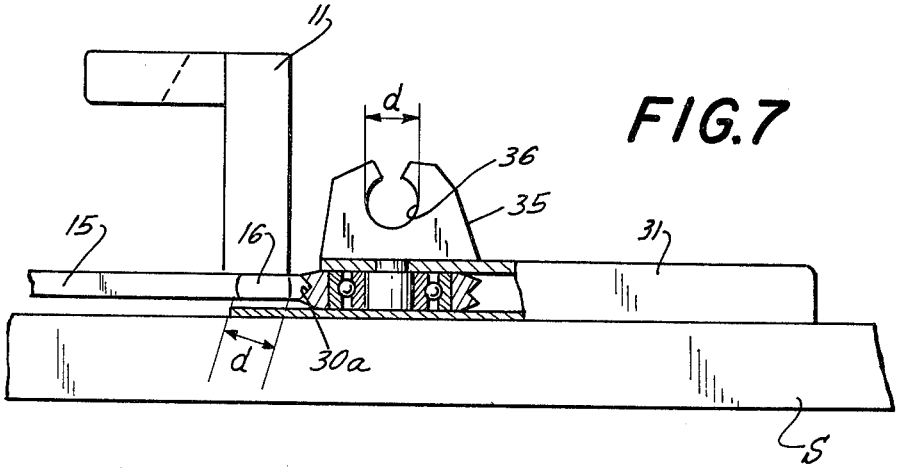
FIG. 7 is a side view partly in section of the toe clamp of FIG. 5.

FIG. 7 also shows how the front plate 31 is formed with two laterally spaced upstanding tabs 35 each having a respective cutout 36 of internal diameter *d* the same as that of the tabs 16 on the plate 1. Thus this plate 1 can be fitted into these seats 36 for simple pivoting of the plate 1 about an axis perpendicular to and slightly above the upper surface of the ski. This type of securing is useful for racing and for holding the plates 1 on the skis when not in use.

I claim:

1. A safety ski binding for securing a skiboot to a ski, said binding comprising:

a plate securable to said skiboot and having a rear heel end formed with a pair of generally forwardly open seats spaced apart transversely to the longitudinal direction of said ski, and with a front end having an edge extending generally perpendicularly to said direction;

a toe clamp on said ski and provided with a wheel pivoted about an upright axis perpendicular to said direction and to the upper surface of said ski and having a circumferential groove lying generally in a plane parallel to said surface; and a heel clamp provided with a pair of rollers spaced apart transversely to said direction and with a swivelable pin having a forward end engageable against said plate between said seats and provided with spring means to urge said edge forwardly into said groove and said seats forwardly against said rollers.

2. The binding defined in claim 1 wherein said seats are part-cylindrical and terminate at their rearmost portions on a common plane perpendicular to said direction.

3. The binding defined in claim 2 wherein said seats are quarter-cylindrical and open forwardly and outwardly.

4. The binding defined in claim 2 wherein said plate is formed immediately forwardly of each of said seats with a second such seat, the second seats being spaced apart perpendicular to said direction by a distance substantially smaller than the spacing of the first-mentioned seats perpendicular to said axis.

5. The binding defined in claim 4 wherein the distance between the base of each of said first seats and that portion of the opposite lateral side of said plate immediately in back of the other said first seats is equal to the spacing between said rollers.

6. The binding defined in claim 1 wherein said rollers are tapered upwardly away from said ski.

* * * * *